US006988690B2

(12) United States Patent
Hsu

(10) Patent No.: US 6,988,690 B2
(45) Date of Patent: Jan. 24, 2006

(54) ADHESIVE TAPE HOLDER

(75) Inventor: Fu-Lu Hsu, Chang Hua Hsien (TW)

(73) Assignee: Luh Da Industry Corp., Lu Kang Chen (TW)

( * ) Notice: Subject to any disclaimer, the term of this patent is extended or adjusted under 35 U.S.C. 154(b) by 159 days.

(21) Appl. No.: 10/755,882

(22) Filed: Jan. 12, 2004

(65) Prior Publication Data

US 2005/0150923 A1 Jul. 14, 2005

(51) Int. Cl.
*B65H 49/00* (2006.01)

(52) U.S. Cl. ..... 242/588.6; 242/406; 225/42; 225/77

(58) Field of Classification Search ..... 242/588, 242/588.3, 588.6, 398, 399, 400, 404, 405, 242/406; 225/39, 42, 46–49, 77
See application file for complete search history.

(56) References Cited

U.S. PATENT DOCUMENTS

| | | | | |
|---|---|---|---|---|
| 4,274,904 | A * | 6/1981 | Harrison et al. | |
| 5,350,099 | A * | 9/1994 | Kienzle | 225/77 |
| 5,667,626 | A * | 9/1997 | Cayford et al. | 242/588.6 |
| 5,992,490 | A * | 11/1999 | Kakita et al. | 225/77 |
| 6,651,857 | B1 * | 11/2003 | Tsai | 225/42 |
| 6,755,108 | B2 * | 6/2004 | Shull et al. | 225/47 |

* cited by examiner

*Primary Examiner*—William A. Rivera
(74) *Attorney, Agent, or Firm*—Alan D. Kamrath; Nikolai & Mersereau, P.A.

(57) ABSTRACT

An adhesive tape holder includes a sucker unit, a link, a blade seat, a guide rack, a support rack, and a rotation wheel. Thus, the adhesive tape holder is attached on a plane rigidly and stably, thereby facilitating the user operating the adhesive tape holder so as to pull the adhesive tape outward easily and conveniently. In addition, the adhesive tape holder is available for a horizontal plane and a vertical plane, thereby facilitating the user operating the adhesive tape holder.

18 Claims, 13 Drawing Sheets

ADHESIVE TAPE HOLDER

BACKGROUND OF THE INVENTION

1. Field of the Invention

The present invention relates to an adhesive tape holder, and more particularly to an adhesive tape holder that is attached on a plane rigidly and stably, thereby facilitating the user operating the adhesive tape holder so as to pull the adhesive tape outward easily and conveniently.

2. Description of the Related Art

A conventional adhesive tape holder comprises a support base having a mediate portion formed with a concave portion, a serrated blade mounted on a front end of the support base, a rotation wheel rotatably mounted in the concave portion of the support base, and a roll of adhesive tape wound around the rotation wheel and having a distal end rested on and cut by the serrated blade. However, the support base is not fixed on the table rigidly and stably, so that the conventional adhesive tape holder easily slides or slips on the table when the adhesive tape is pulled outward from the support base. Thus, the user has to hold the support base by his one hand and to pull the adhesive tape outward from the support base by his other hand, thereby greatly causing inconvenience to the user.

SUMMARY OF THE INVENTION

The primary objective of the present invention is to provide an adhesive tape holder that is attached on a plane rigidly and stably, thereby facilitating the user operating the adhesive tape holder so as to pull the adhesive tape outward easily and conveniently.

Another objective of the present invention is to provide an adhesive tape holder that is available for a horizontal plane and a vertical plane, thereby facilitating the user operating the adhesive tape holder.

A further objective of the present invention is to provide an adhesive tape holder that has a light weight and can be folded easily, thereby facilitating transportation and saving space of storage of the adhesive tape holder.

In accordance with one embodiment of the present invention, there is provided an adhesive tape holder, comprising a sucker unit, a link, a blade seat, a guide rack, a support rack, and a rotation wheel, wherein:

the sucker unit produces an attractive force;

the link is mounted on the sucker unit;

the blade seat is substantially L-shaped and has a first section mounted on the link and a second section provided with a serrated blade;

the guide rack is substantially U-shaped and has a first section formed with a locking seat mounted on the link and a second section formed with a support seat, a roller is rotatably mounted on the support seat of the guide rack;

the support rack has a first section formed with a fixing seat mounted on the link and a second section formed with two substantially L-shaped opposite support bars each having a first section extended outward from the fixing seat of the support rack and a second section formed with a support slot; and the rotation wheel is rotatably mounted between the support bars of the support rack and is provided with a shaft rotatably mounted in the support slot of each of the support bars.

In accordance with another embodiment of the present invention, there is provided an adhesive tape holder, comprising a sucker unit, a support member, a blade seat, a support rack, and a rotation wheel, wherein:

the sucker unit produces an attractive force;

the support member is substantially Z-shaped and is mounted on the sucker unit;

the blade seat is substantially L-shaped and has a first section mounted on the support member and a second section provided with a serrated blade;

the support rack has a first section formed with a fixing seat mounted on the support member and a second section formed with two substantially L-shaped opposite support bars each having a first section extended outward from the fixing seat of the support rack and a second section formed with a support slot; and the rotation wheel is rotatably mounted between the support bars of the support rack and is provided with a shaft rotatably mounted in the support slot of each of the support bars.

Further benefits and advantages of the present invention will become apparent after a careful reading of the detailed description with appropriate reference to the accompanying drawings.

DETAILED DESCRIPTION OF THE INVENTION

Figure 1:
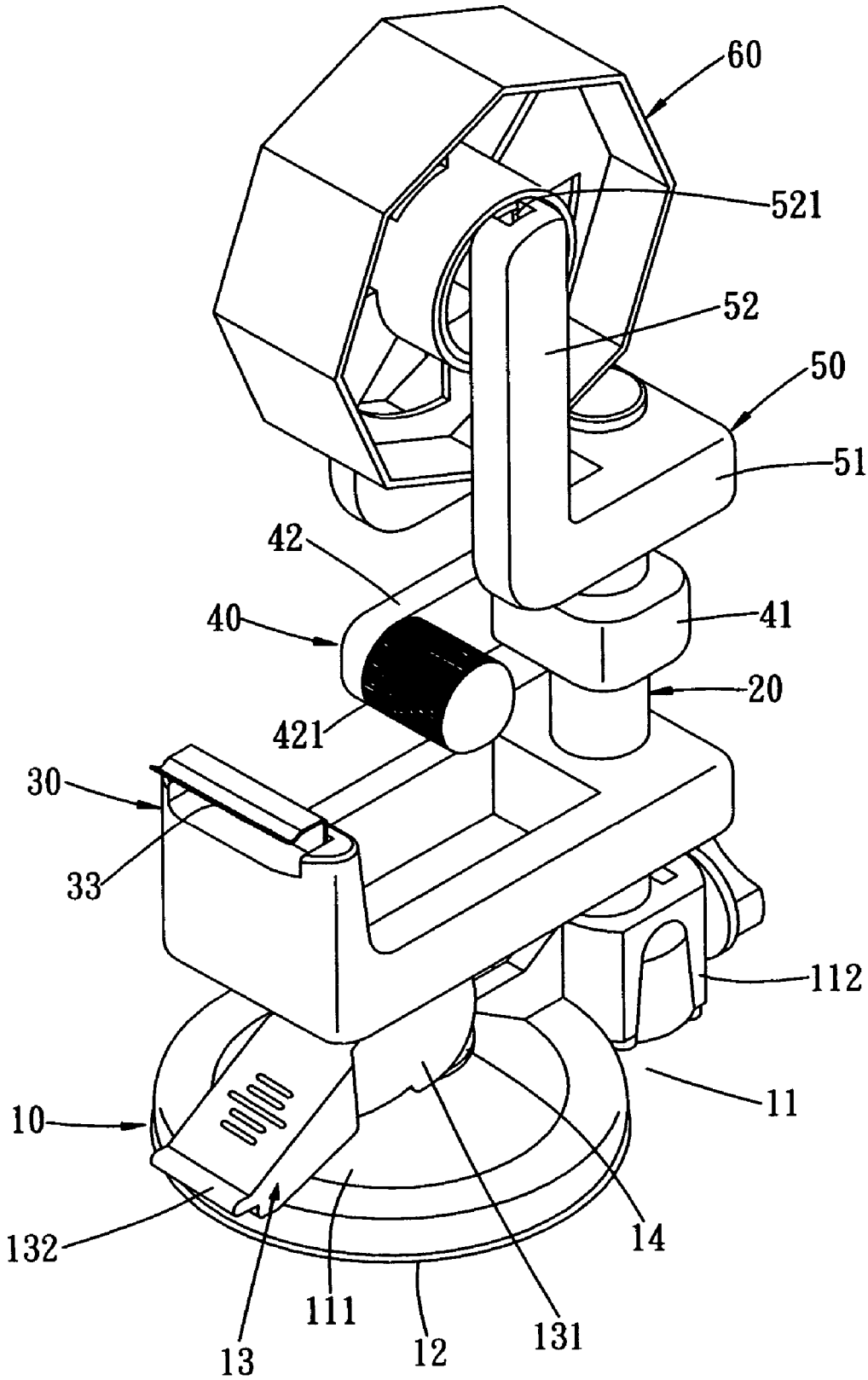
FIG. 1 is a perspective view of an adhesive tape holder in accordance with the preferred embodiment of the present invention.

Referring to the drawings and initially to FIGS. 1–4, an adhesive tape holder in accordance with the preferred embodiment of the present invention comprises a sucker unit 10, a link 20, a blade seat 30, a guide rack 40, a support rack 50, and a rotation wheel 60.

The sucker unit 10 includes a base 11 including a disk 111, and a combination seat 112 extended outward from a side of the disk 111 and having an inside formed with an insertion hole 1120, an elastic plate 14 mounted on a top of the disk 111 of the base 11, a sucker 12 mounted on a bottom of the disk 111 of the base 11 and having a top face provided with an outward extending shaft 121 extended through the disk 111 of the base 11 and the elastic plate 14, an actuating handle 13 having a first end formed with an enlarged head 131 pivotally mounted on the shaft 121 of the sucker 12 in an eccentrically manner and urged on the elastic plate 14 and a second end formed with a drive portion 132, and a rotation bolt 15 extended through the combination seat 112 of the base 11 into the insertion hole 1120 of the combination seat 112.

Figure 2:
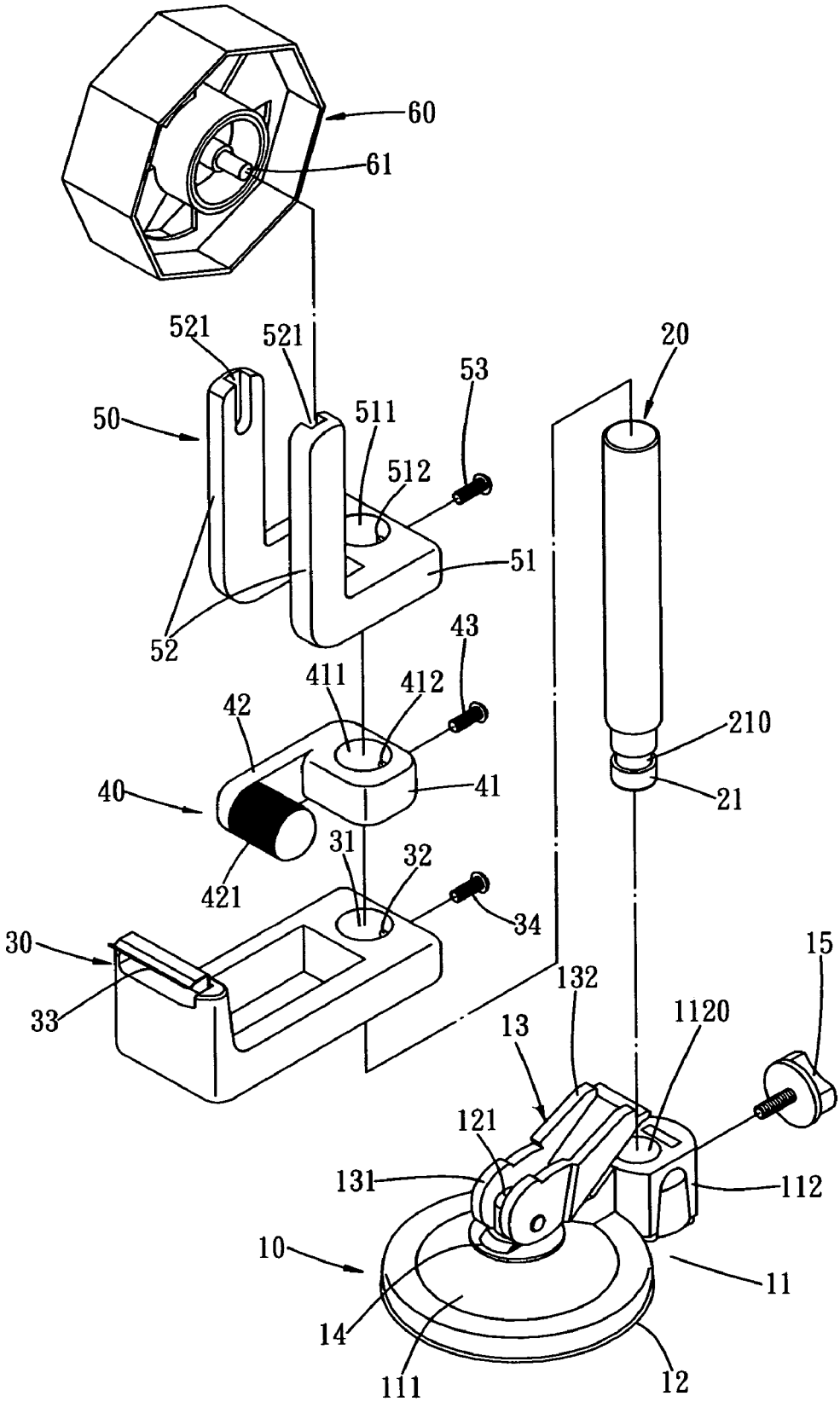
FIG. 2 is an exploded perspective view of the adhesive tape holder as shown in FIG. 1.
Figure 2A:
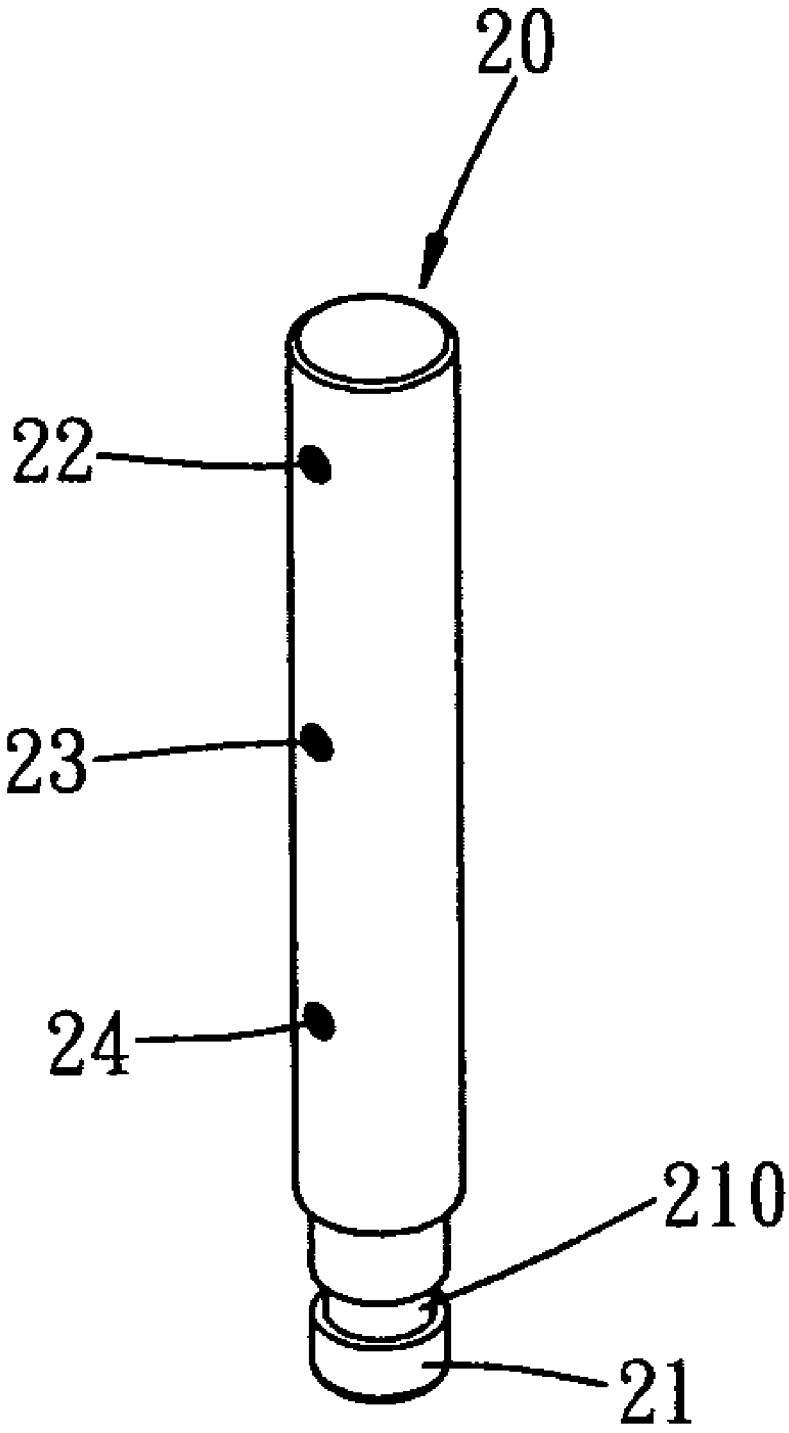
FIG. 2A is a perspective view of a link of the adhesive tape holder as shown in FIG. 2.

As shown in FIGS. 2 and 2A, the link 20 is mounted on the combination seat 112 of the base 11 and has a distal end formed with an insertion section 21 inserted into the insertion hole 1120 of the combination seat 112. The insertion section 21 of the link 20 is formed with an annular groove 210, and the rotation bolt 15 is locked in the annular groove 210 of the insertion section 21, so that the link 20 is fixed on the combination seat 112 of the base 11. The link 20 has a peripheral wall formed with a first screw bore 24 located above the insertion section 21, a second screw bore 23 located above the first screw bore 24, and a third screw bore 22 located above the second screw bore 23.

The blade seat 30 is substantially L-shaped. The blade seat 30 is mounted on the link 20 and has a first section formed with a mounting hole 31 for mounting the link 20 and a second section provided with a serrated blade 33. The first section of the blade seat 30 has a peripheral wall formed with a fixing hole 32 communicating with the mounting hole 31, and the adhesive tape holder further comprises a locking screw 34 extended through the fixing hole 32 of the blade seat 30 and screwed into the first screw bore 24 of the link 20, so that the blade seat 30 is fixed on the link 20.

The guide rack 40 is substantially U-shaped. The guide rack 40 is mounted on the link 20 and has a first section formed with a locking seat 41 formed with a mounting hole 411 for mounting the link 20 and a second section formed with a support seat 42. A roller 421 is rotatably mounted on the support seat 42 of the guide rack 40. The locking seat 41 of the guide rack 40 has a peripheral wall formed with a fixing hole 412 communicating with the mounting hole 411, and the adhesive tape holder further comprises a locking screw 43 extended through the fixing hole 412 of the guide rack 40 and screwed into the second screw bore 23 of the link 20, so that the guide rack 40 is fixed on the link 20.

The support rack 50 is mounted on the link 20 and has a first section formed with a fixing seat 51 formed with a mounting hole 511 for mounting the link 20 and a second section formed with two substantially L-shaped opposite support bars 52. The fixing seat 51 of the support rack 50 has a peripheral wall formed with a fixing hole 512 communicating with the mounting hole 511, and the adhesive tape holder further comprises a locking screw 53 extended through the fixing hole 512 of the support rack 50 and screwed into the third screw bore 22 of the link 20, so that the support rack 50 is fixed on the link 20. Each of the support bars 52 has a first section extended outward from the fixing seat 51 of the support rack 50 and a second section formed with a support slot 521.

The rotation wheel 60 is rotatably mounted between the support bars 52 of the support rack 50 and has a center provided with a shaft 61 rotatably mounted in the support slot 521 of each of the support bars 52.

Figure 3:
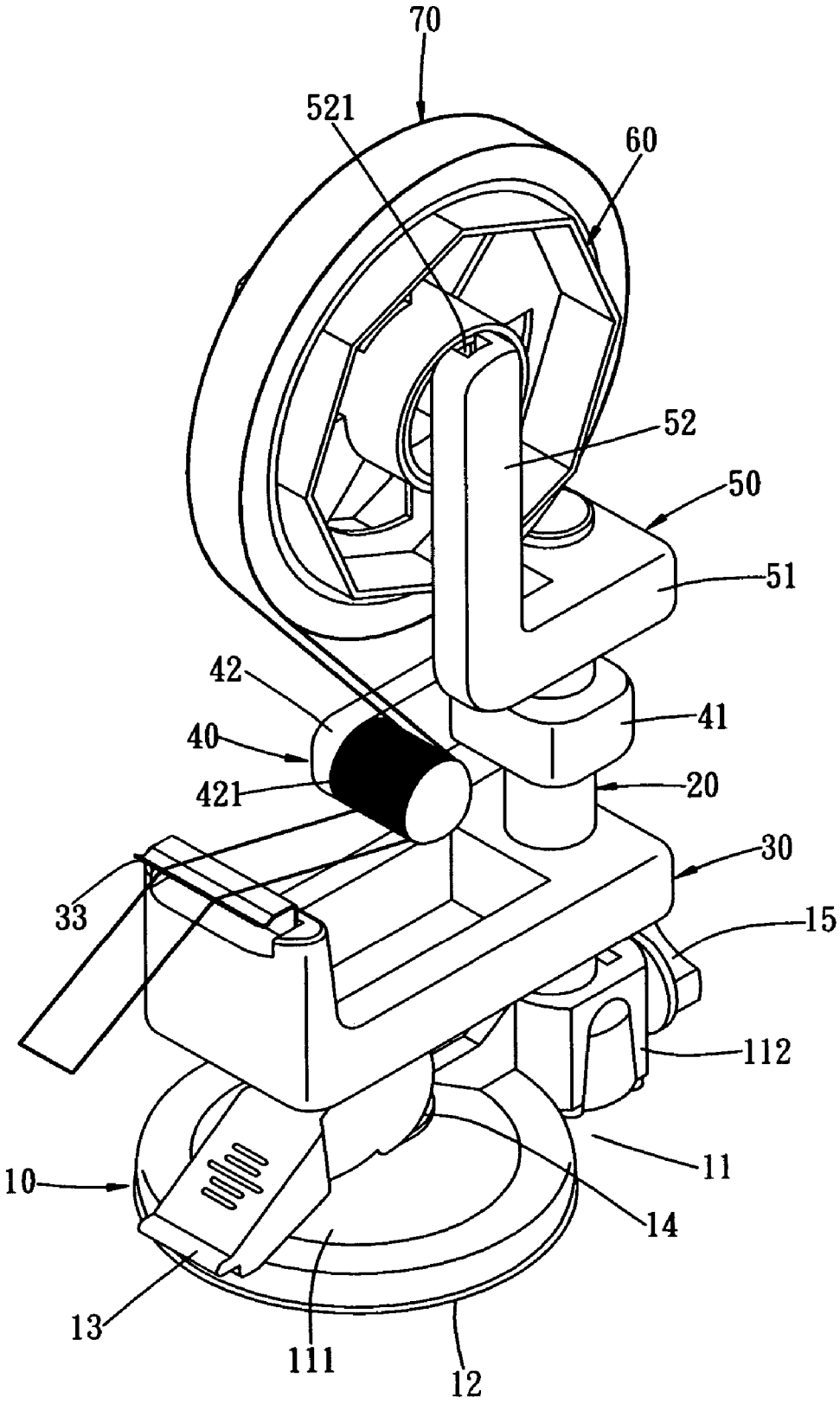
FIG. 3 is a schematic operational view of the adhesive tape holder as shown in FIG. 1.
Figure 4:
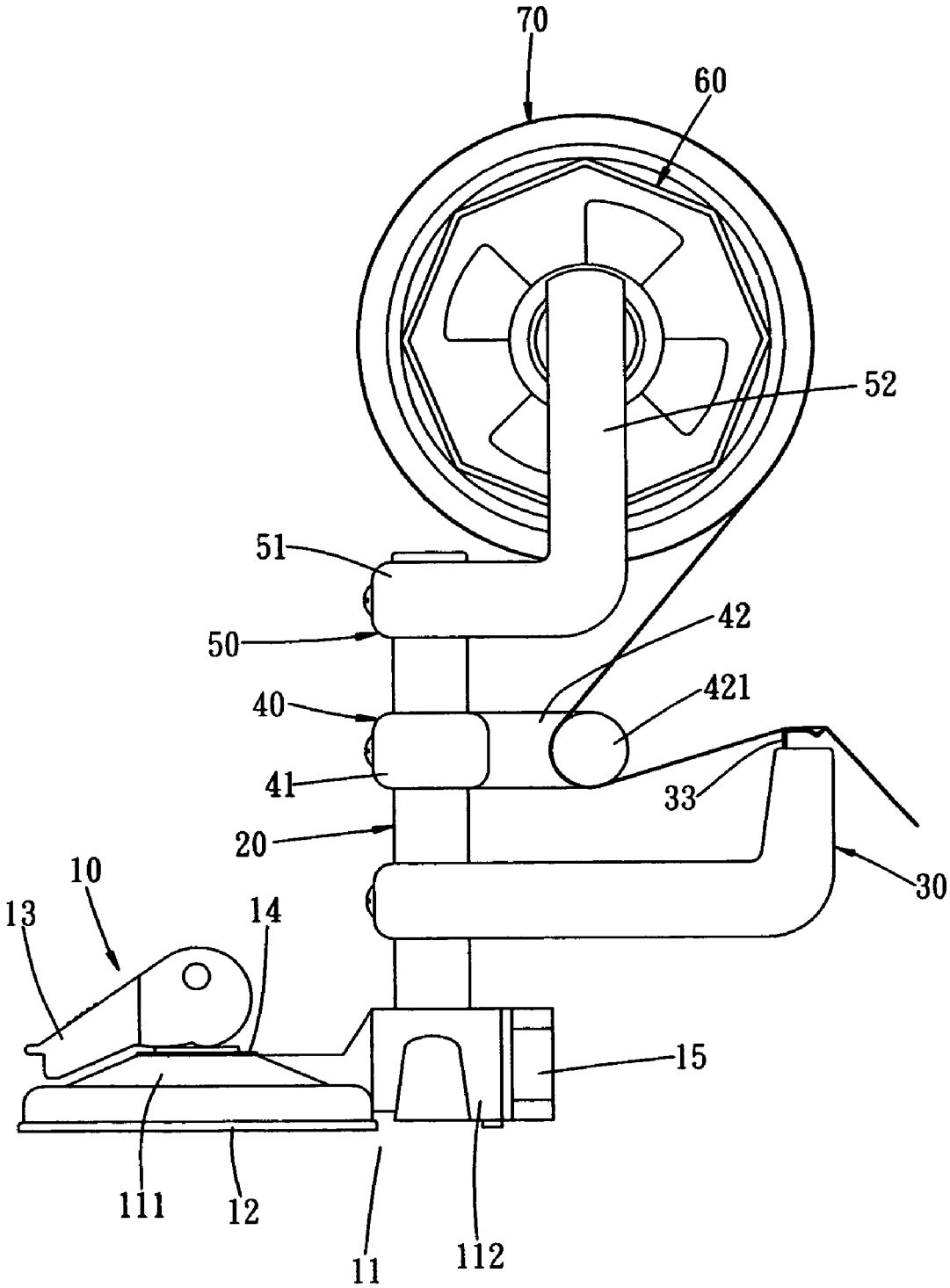
FIG. 4 is a schematic plan view of the adhesive tape holder as shown in FIG. 3.

As shown in FIGS. 3 and 4, a roll of adhesive tape 70 is wound around the rotation wheel 60 and has a distal end in turn extended through the roller 421 of the guide rack 40 and rested on the serrated blade 33 of the blade seat 30.

In practice, the sucker 12 is mounted on a horizontal plane (not shown), and the actuating handle 13 is pivoted on the shaft 121 of the sucker 12 in an eccentric manner, so that the enlarged head 131 of the actuating handle 13 is urged on the elastic plate 14, and the sucker 12 is pulled upward by the shaft 121, thereby deforming the sucker 12 whose center is protruded outward to produce a stronger attractive force to bond the sucker 12 on the table rigidly and stably. Thus, the adhesive tape holder is attached on the horizontal plane rigidly and stably, thereby facilitating the user operating the adhesive tape holder.

Figure 5:
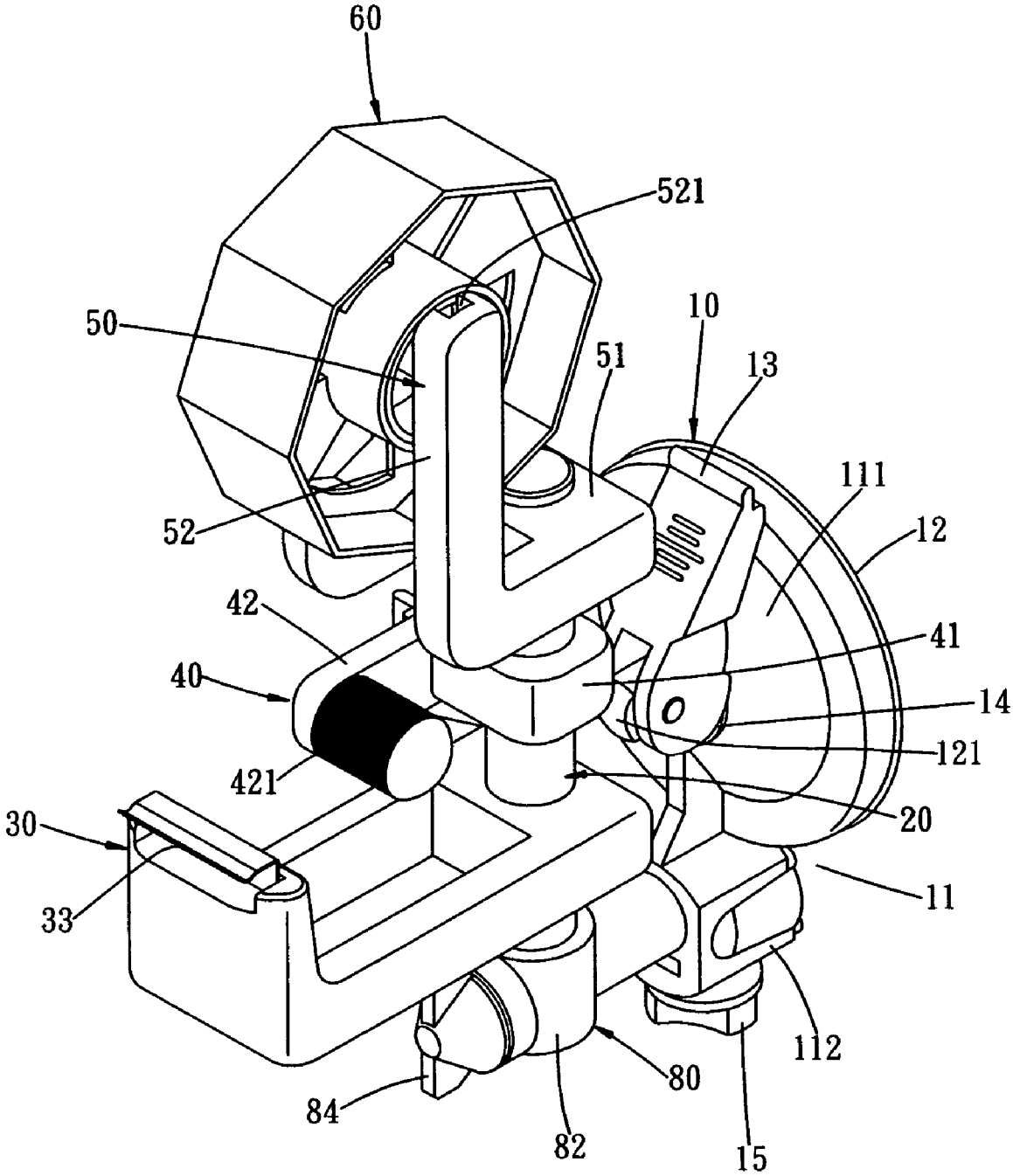
FIG. 5 is a perspective view of an adhesive tape holder in accordance with another embodiment of the present invention.
Figure 6:
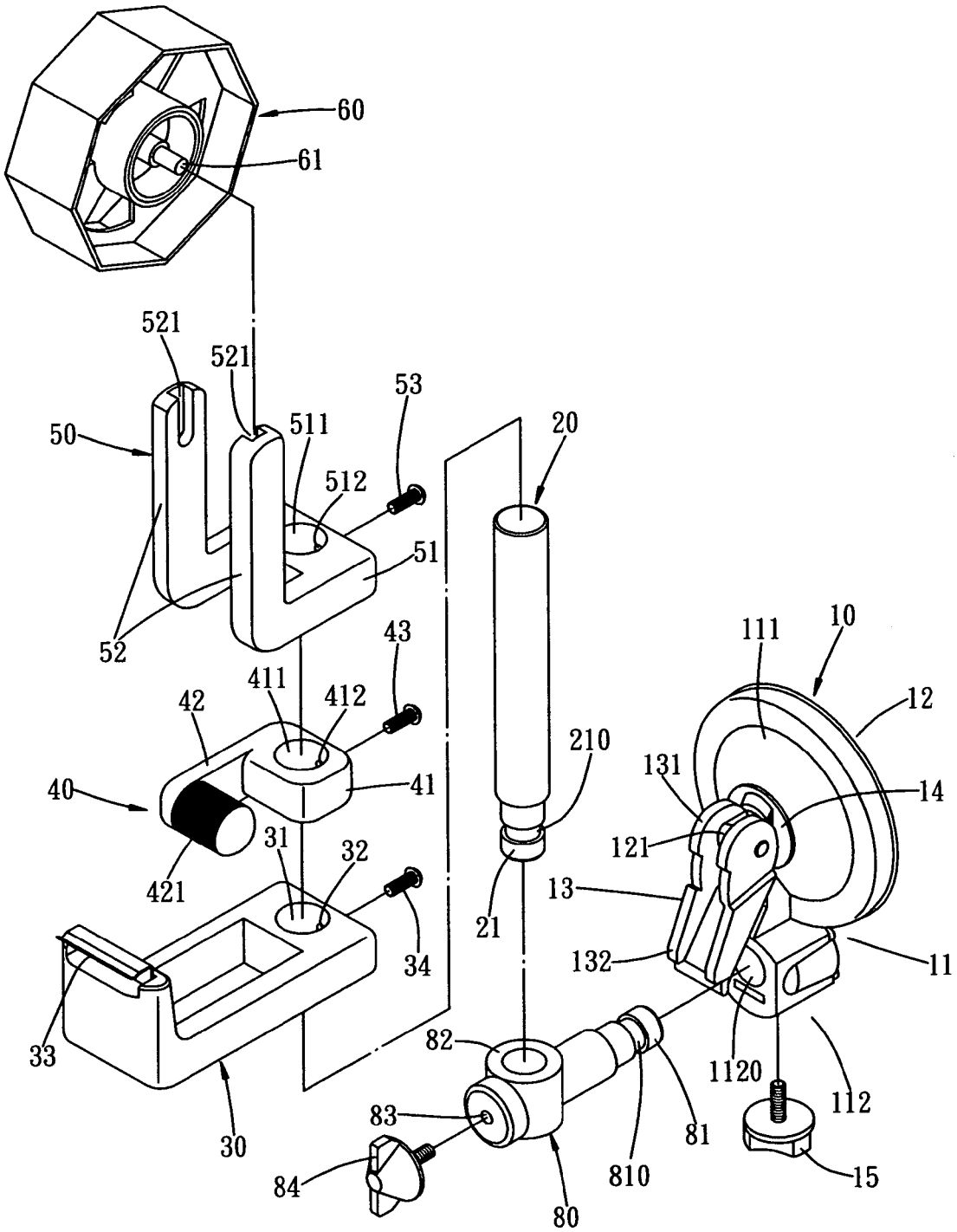
FIG. 6 is an exploded perspective view of the adhesive tape holder as shown in FIG. 5.
Figure 6A:
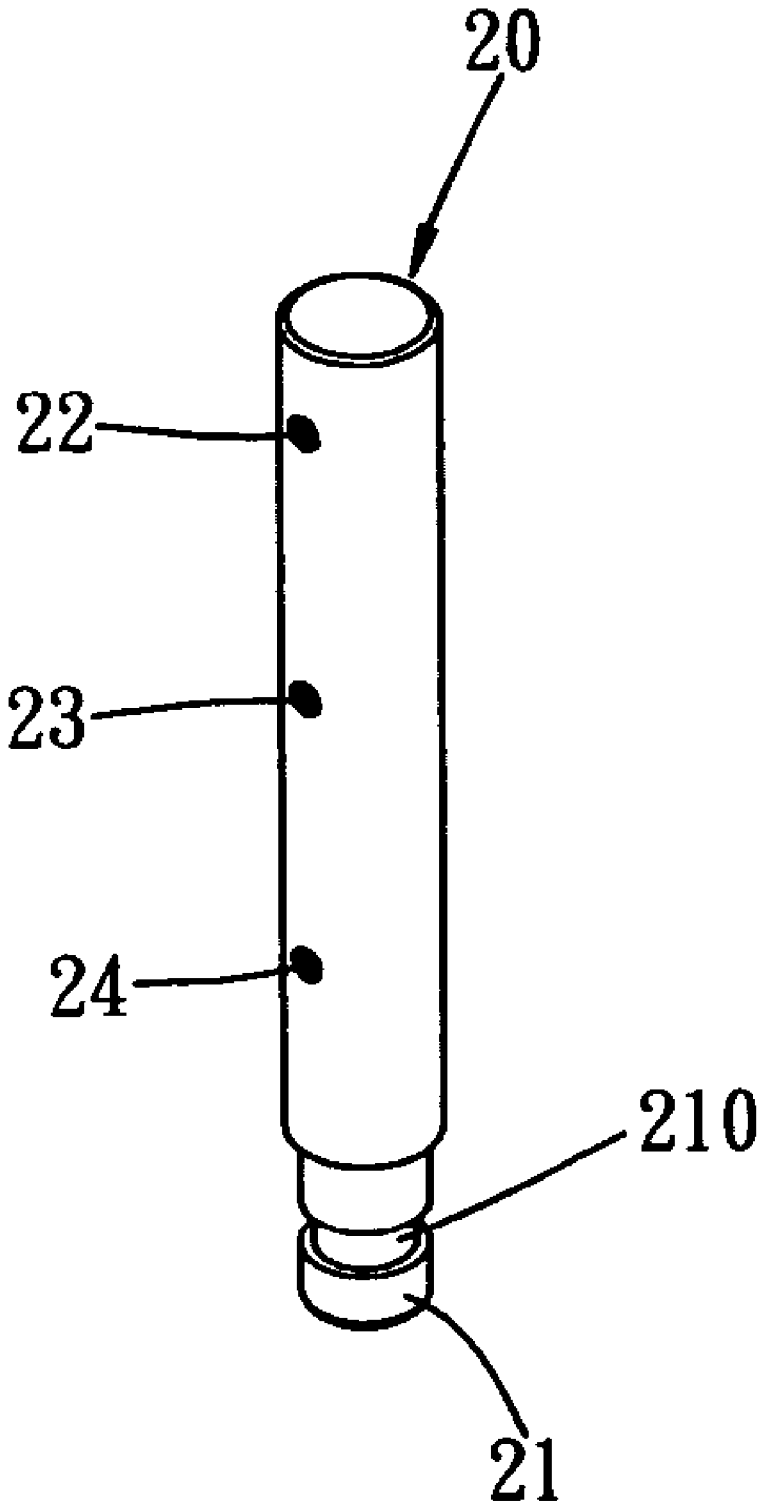
FIG. 6A is a perspective view of a link of the adhesive tape holder as shown in FIG. 6.
Figure 7:
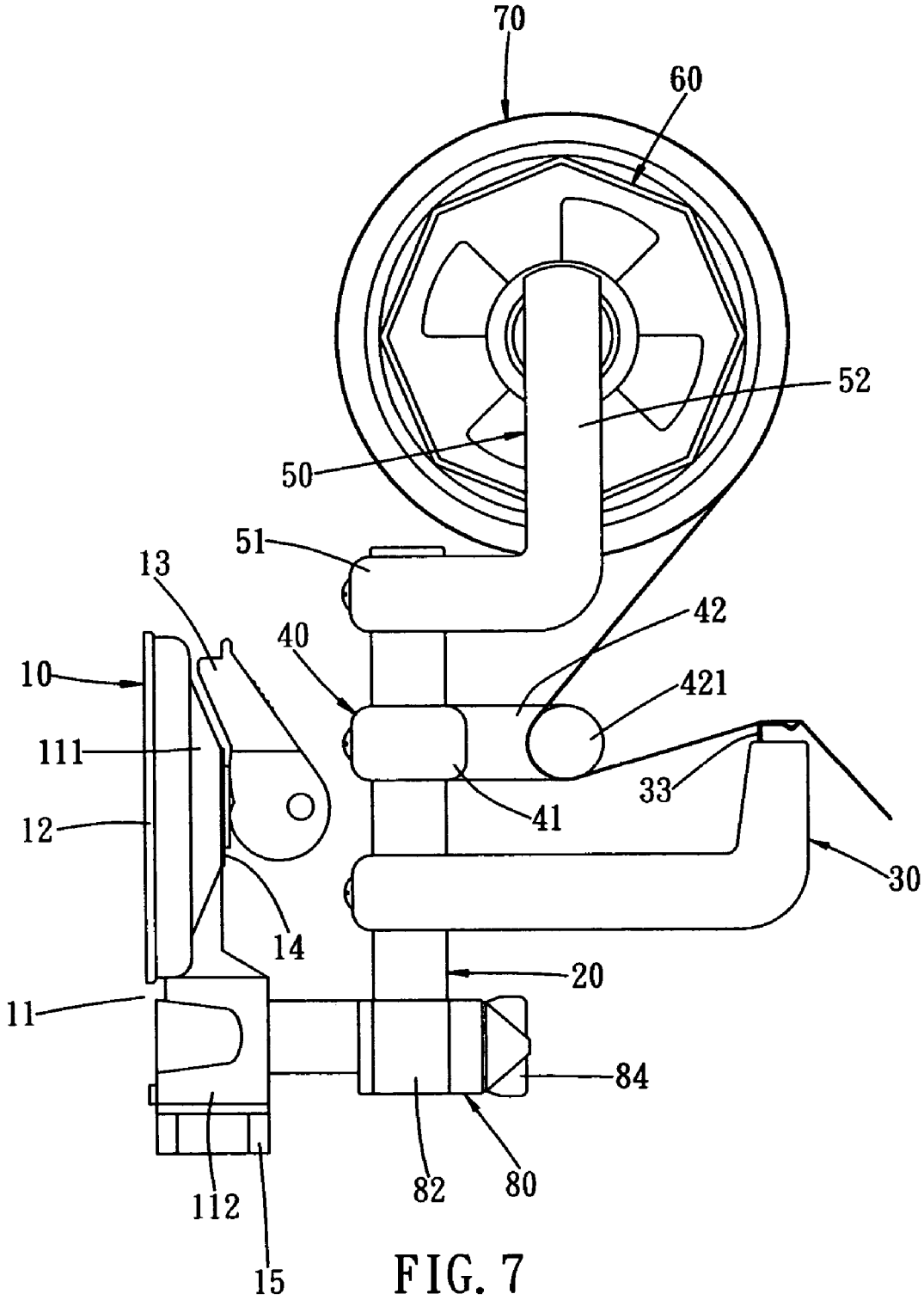
FIG. 7 is a schematic plan view of the adhesive tape holder as shown in FIG. 5.

Referring to FIGS. 5–7, the adhesive tape holder further comprises a connecting post 80 mounted between the combination seat 112 of the base 11 and the link 20 and having a first end formed with an insertion section 81 inserted into the insertion hole 1120 of the combination seat 112 and a second end formed with a socket 82 mounted on the insertion section 21 of the link 20. The insertion section 81 of the connecting post 80 is formed with an annular groove 810, and the rotation bolt 15 is locked in the annular groove 810 of the insertion section 81, so that the connecting post 80 is fixed on the combination seat 112 of the base 11. The socket 82 of the connecting post 80 has a peripheral wall formed with a screw bore 83 communicating with an inside of the socket 82, and the adhesive tape holder further comprises a rotation bolt 84 screwed into the screw bore 83 of the socket 82 and locked in the annular groove 210 of the insertion section 21, so that the link 20 is fixed on the connecting post 80.

In practice, the sucker 12 is mounted on a vertical plane (not shown), and the actuating handle 13 is pivoted on the shaft 121 of the sucker 12 in an eccentric manner, so that the enlarged head 131 of the actuating handle 13 is urged on the elastic plate 14, and the sucker 12 is pulled upward by the shaft 121, thereby deforming the sucker 12 whose center is protruded outward to produce a stronger attractive force to bond the sucker 12 on the table rigidly and stably. Thus, the adhesive tape holder is attached on the vertical plane rigidly and stably, thereby facilitating the user operating the adhesive tape holder.

Figure 8:
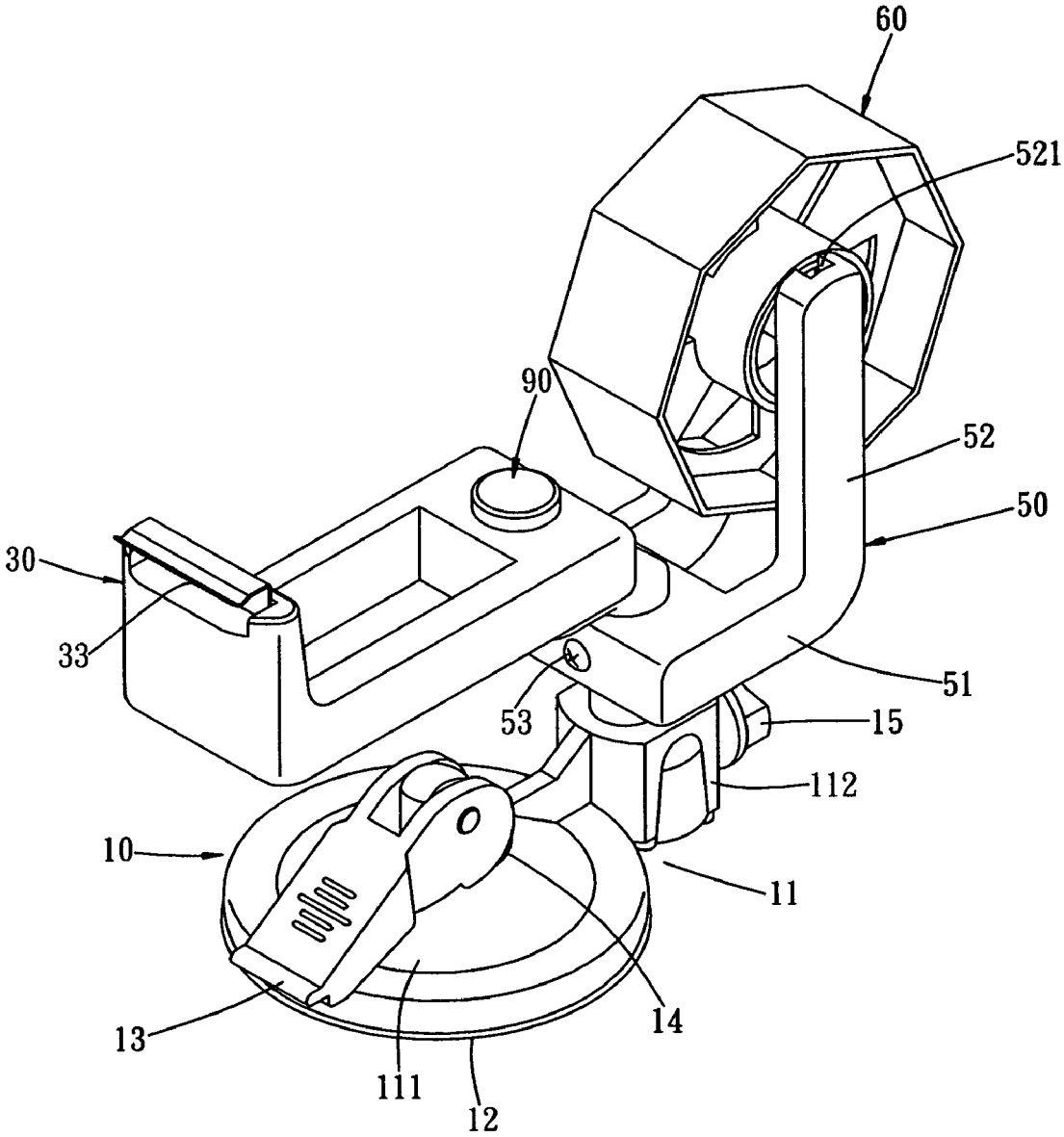
FIG. 8 is a perspective view of an adhesive tape holder in accordance with another embodiment of the present invention.
Figure 9:
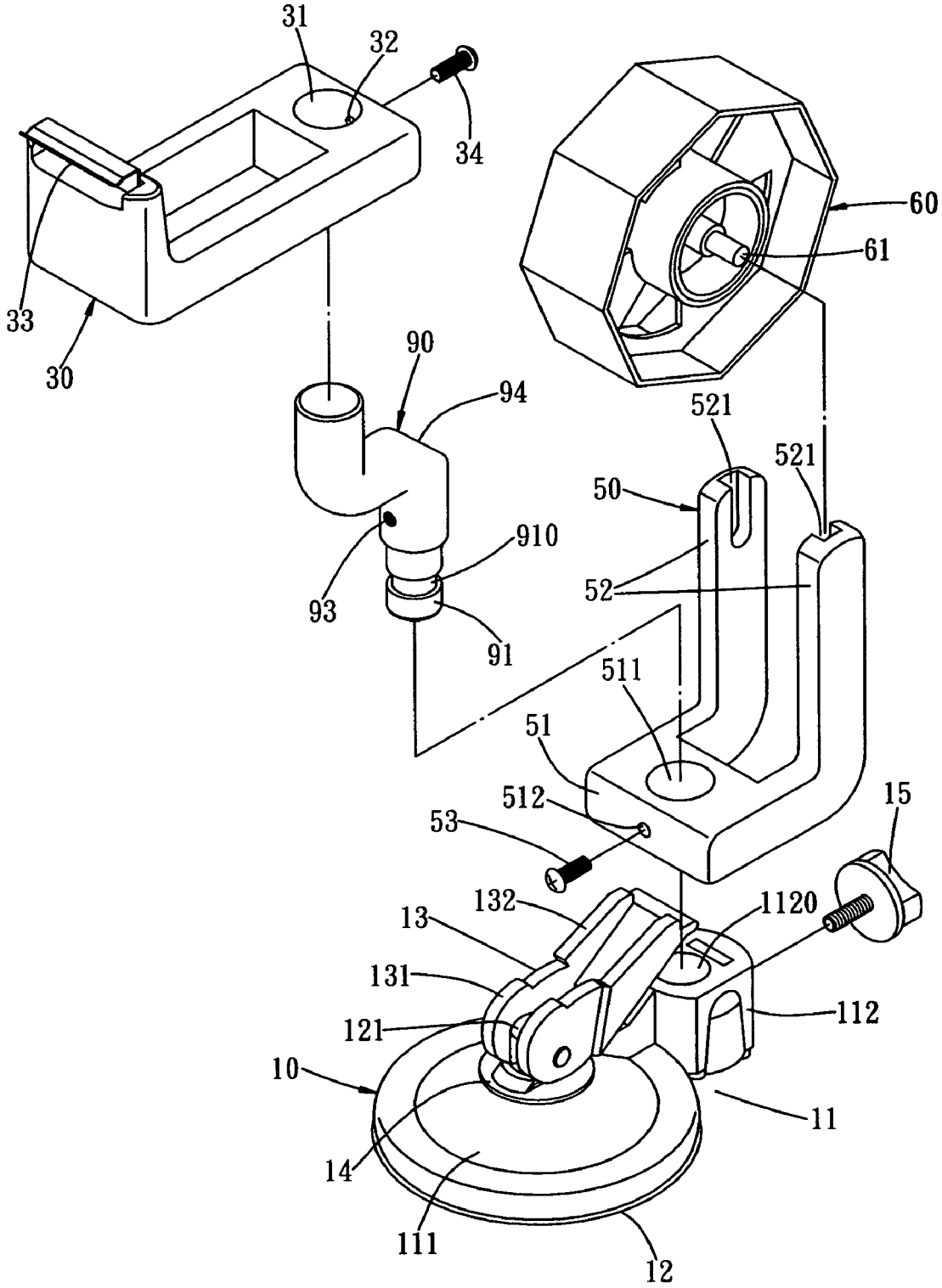
FIG. 9 is an exploded perspective view of the adhesive tape holder as shown in FIG. 8.
Figure 9A:
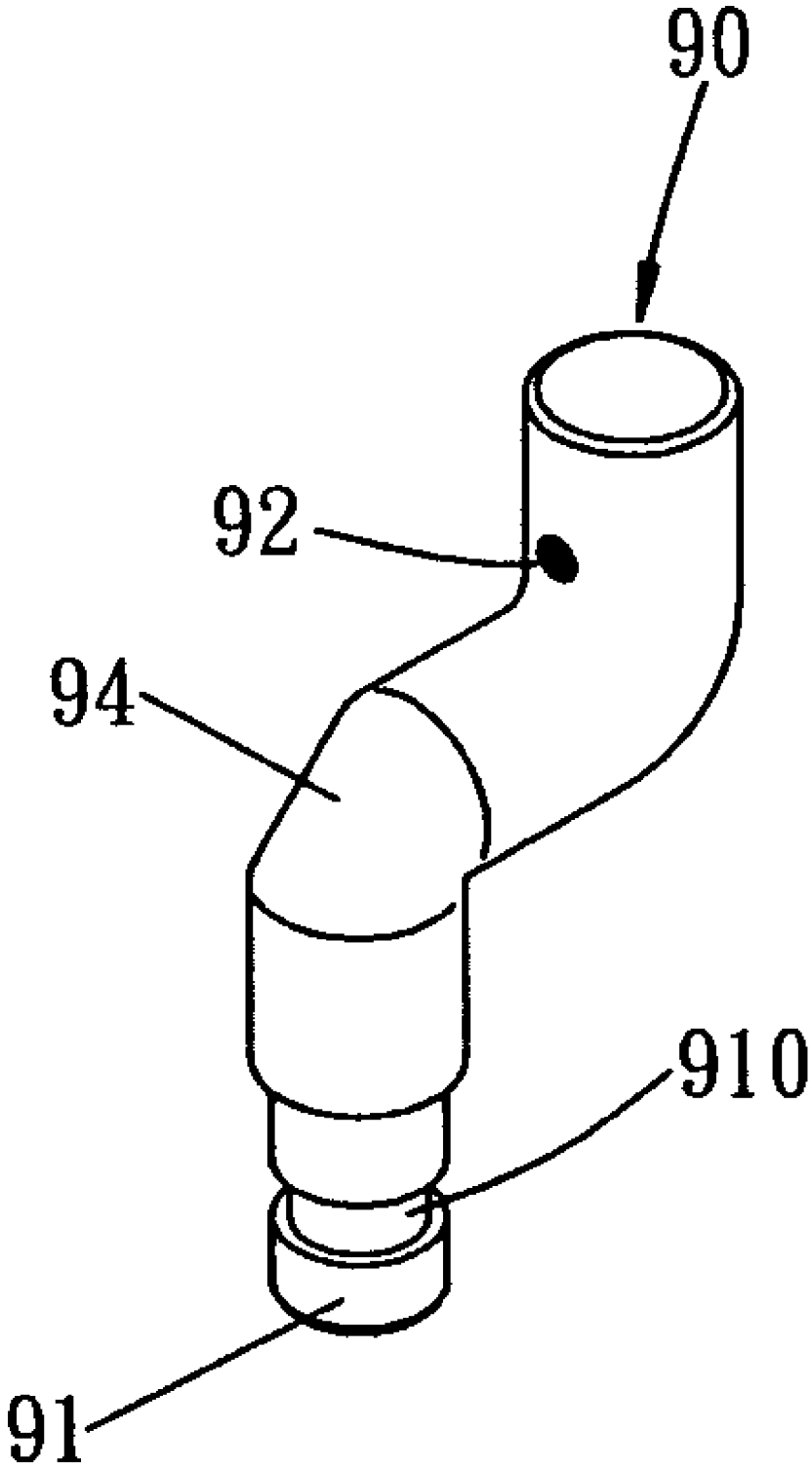
FIG. 9A is a perspective view of a support member of the adhesive tape holder as shown in FIG. 9.
Figure 10:
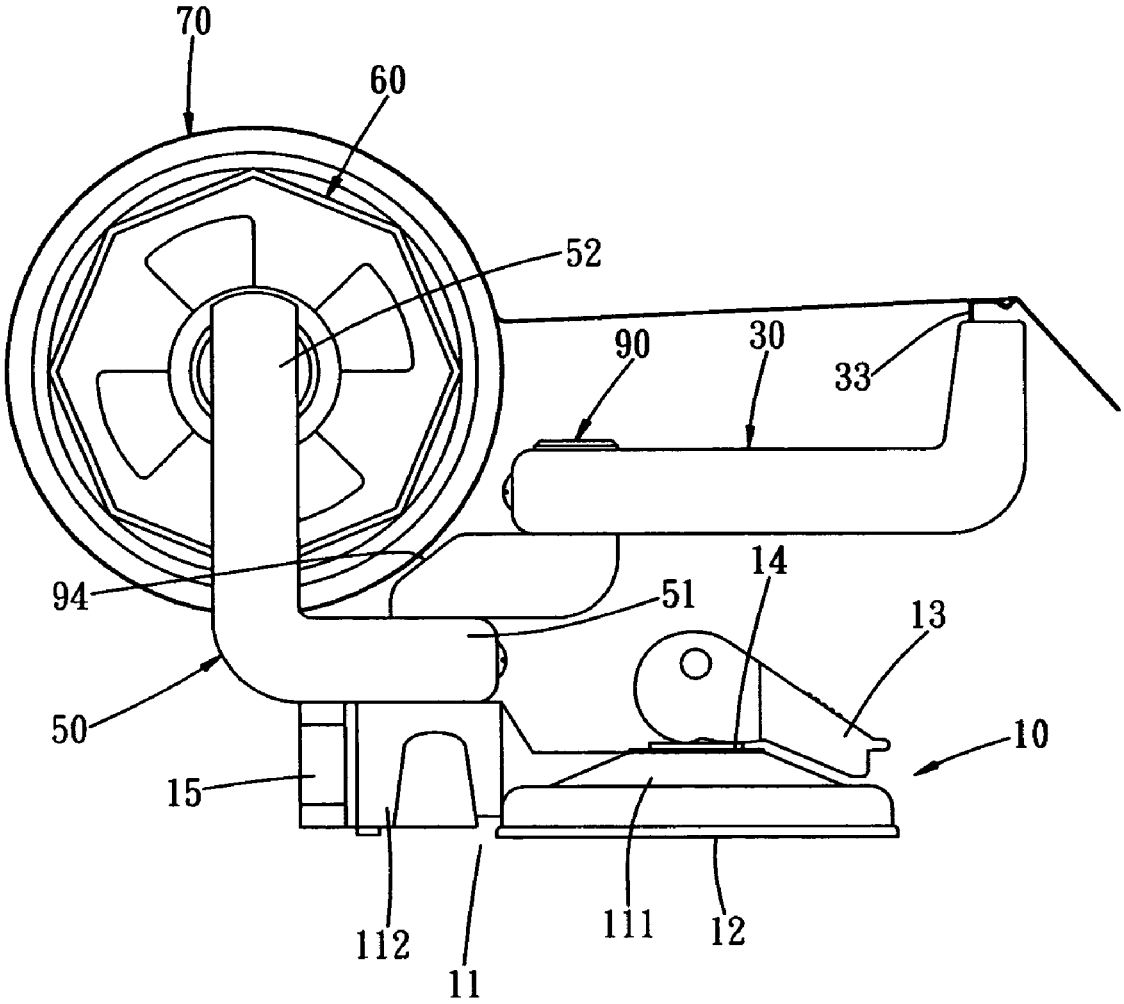
FIG. 10 is a schematic plan view of the adhesive tape holder as shown in FIG. 8.

Referring to FIGS. 8–10, the link 20 and the guide rack 40 are removed, and the adhesive tape holder further comprises a substantially Z-shaped support member 90 mounted between the combination seat 112 of the base 11, the support rack 50 and the blade seat 30. The support member 90 has a first end formed with an insertion section 91 inserted into the insertion hole 1120 of the combination seat 112 and a screw bore 93 located above the insertion section 91. The insertion section 91 of the support member 90 is formed with an annular groove 910, and the rotation bolt 15 is locked in the annular groove 910 of the insertion section 91, so that the support member 90 is fixed on the combination seat 112 of the base 11. The fixing seat 51 of the support rack 50 is mounted on the first end of the support member 90, and the locking screw 53 is extended through the fixing hole 512 of the support rack 50 and screwed into the screw bore 93 of the support member 90, so that the support rack 50 is fixed on the support member 90. The support member 90 has a second end formed with a screw bore 92 (see FIG. 9A), the mounting hole 31 of the blade seat 30 is mounted on the second end of the support member 90, and the locking screw 34 is extended through the fixing hole 32 of the blade seat 30 and screwed into the screw bore 92 of the support member 90, so that the blade seat 30 is fixed on the support member 90. The support member 90 has a mediate portion formed with a ramp 94 spaced from the rotation wheel 60.

As shown in FIG. 10, a roll of adhesive tape 70 is wound around the rotation wheel 60 and has a distal end directly rested on the serrated blade 33 of the blade seat 30.

Accordingly, the adhesive tape holder is attached on a plane rigidly and stably, thereby facilitating the user operating the adhesive tape holder so as to pull the adhesive tape 70 outward easily and conveniently. In addition, the adhesive tape holder is available for a horizontal plane and a vertical plane, thereby facilitating the user operating the adhesive tape holder. Further, the adhesive tape holder has a light weight and can be folded easily, thereby facilitating transportation and saving space of storage of the adhesive tape holder.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An adhesive tape holder, comprising a sucker unit, a link, a blade seat, a guide rack, a support rack, and a rotation wheel, wherein:

the sucker unit produces an attractive force;

the link is mounted on the sucker unit;

the blade seat is substantially L-shaped and has a first section mounted on the link and a second section provided with a serrated blade;

the guide rack is substantially U-shaped and has a first section formed with a locking seat mounted on the link and a second section formed with a support seat, a roller is rotatably mounted on the support seat of the guide rack;

the support rack has a first section formed with a fixing seat mounted on the link and a second section formed with two substantially L-shaped opposite support bars each having a first section extended outward from the fixing seat of the support rack and a second section formed with a support slot; and the rotation wheel is rotatably mounted between the support bars of the support rack and is provided with a shaft rotatably mounted in the support slot of each of the support bars.

2. The adhesive tape holder in accordance with claim 1, wherein the sucker unit includes a base including a disk, and a combination seat extended outward from a side of the disk and having an inside formed with an insertion hole, an elastic plate mounted on a top of the disk of the base, a sucker mounted on a bottom of the disk of the base and having a top face provided with an outward extending shaft extended through the disk of the base and the elastic plate, an actuating handle having a first end formed with an enlarged head pivotally mounted on the shaft of the sucker in an eccentrically manner and urged on the elastic plate and a second end formed with a drive portion, and a rotation bolt extended through the combination seat of the base into the insertion hole of the combination seat.

3. The adhesive tape holder in accordance with claim 2, wherein the link is mounted on the combination seat of the base and has a distal end formed with an insertion section inserted into the insertion hole of the combination seat, the insertion section of the link is formed with an annular groove, and the rotation bolt is locked in the annular groove of the insertion section, so that the link is fixed on the combination seat of the base.

4. The adhesive tape holder in accordance with claim 2, further comprising a connecting post mounted between the combination seat of the base and the link and having a first end formed with an insertion section inserted into the insertion hole of the combination seat and a second end formed with a socket, wherein the link has a distal end formed with an insertion section inserted into the socket of the connecting post.

5. The adhesive tape holder in accordance with claim 4, wherein the insertion section of the connecting post is formed with an annular groove, and the rotation bolt is locked in the annular groove of the insertion section, so that the connecting post is fixed on the combination seat of the base.

6. The adhesive tape holder in accordance with claim 4, wherein the socket of the connecting post has a peripheral wall formed with a screw bore communicating with an inside of the socket, the insertion section of the link is formed with an annular groove, and the adhesive tape holder further comprises a rotation bolt screwed into the screw bore of the socket and locked in the annular groove of the insertion section, so that the link is fixed on the connecting post.

7. The adhesive tape holder in accordance with claim 1, wherein the link has a peripheral wall formed with a first screw bore, a second screw bore located above the first screw bore, and a third screw bore located above the second screw bore.

8. The adhesive tape holder in accordance with claim 7, wherein the first section of the blade seat is formed with a mounting hole for mounting the link, the first section of the blade seat has a peripheral wall formed with a fixing hole communicating with the mounting hole, and the adhesive tape holder further comprises a locking screw extended through the fixing hole of the blade seat and screwed into the first screw bore of the link, so that the blade seat is fixed on the link.

9. The adhesive tape holder in accordance with claim 7, wherein the locking seat of the guide rack is formed with a mounting hole for mounting the link, the locking seat of the guide rack has a peripheral wall formed with a fixing hole communicating with the mounting hole, and the adhesive tape holder further comprises a locking screw extended through the fixing hole of the guide rack and screwed into the second screw bore of the link, so that the guide rack is fixed on the link.

10. The adhesive tape holder in accordance with claim 7, wherein the fixing seat of the support rack is formed with a mounting hole for mounting the link, the fixing seat of the support rack has a peripheral wall formed with a fixing hole communicating with the mounting hole, and the adhesive tape holder further comprises a locking screw extended through the fixing hole of the support rack and screwed into the third screw bore of the link, so that the support rack is fixed on the link.

11. The adhesive tape holder in accordance with claim 1, further comprising a roll of adhesive tape wound around the rotation wheel and having a distal end in turn extended through the roller of the guide rack and rested on the serrated blade of the blade seat.

12. An adhesive tape holder, comprising a sucker unit, a support member, a blade seat, a support rack, and a rotation wheel, wherein:

the sucker unit produces an attractive force;

the support member is substantially Z-shaped and is mounted on the sucker unit;

the blade seat is substantially L-shaped and has a first section mounted on the support member and a second section provided with a serrated blade;

the support rack has a first section formed with a fixing seat mounted on the support member and a second section formed with two substantially L-shaped opposite support bars each having a first section extended outward from the fixing seat of the support rack and a second section formed with a support slot; and the rotation wheel is rotatably mounted between the support bars of the support rack and is provided with a shaft rotatably mounted in the support slot of each of the support bars.

13. The adhesive tape holder in accordance with claim 12, wherein the sucker unit includes a base including a disk, and a combination seat extended outward from a side of the disk and having an inside formed with an insertion hole, an elastic plate mounted on a top of the disk of the base, a sucker mounted on a bottom of the disk of the base and having a top face provided with an outward extending shaft extended through the disk of the base and the elastic plate, an actuating handle having a first end formed with an enlarged head pivotally mounted on the shaft of the sucker in an eccentrically manner and urged on the elastic plate and a second end formed with a drive portion, and a rotation bolt extended through the combination seat of the base into the insertion hole of the combination seat.

14. The adhesive tape holder in accordance with claim 13, wherein the support member has a first end formed with an insertion section inserted into the insertion hole of the combination seat, the insertion section of the support member is formed with an annular groove, and the rotation bolt is locked in the annular groove of the insertion section, so that the support member is fixed on the combination seat of the base.

15. The adhesive tape holder in accordance with claim 14, wherein the first end of the support member is formed with a screw bore, the fixing seat of the support rack is formed with a mounting hole for mounting the support member, the fixing seat of the support rack has a peripheral wall formed with a fixing hole communicating with the mounting hole, and the adhesive tape holder further comprises a locking screw extended through the fixing hole of the support rack and screwed into the third screw bore of the support member, so that the support rack is fixed on the support member.

16. The adhesive tape holder in accordance with claim 13, wherein the support member has a second end formed with a screw bore, the first section of the blade seat is formed with a mounting hole for mounting the support member, the first section of the blade seat has a peripheral wall formed with a fixing hole communicating with the mounting hole, and the adhesive tape holder further comprises a locking screw extended through the fixing hole of the blade seat and screwed into the screw bore of the support member, so that the blade seat is fixed on the support member.

17. The adhesive tape holder in accordance with claim 12, wherein the support member has a mediate portion formed with a ramp spaced from the rotation wheel.

18. The adhesive tape holder in accordance with claim 12, further comprising a roll of adhesive tape wound around the rotation wheel and having a distal end rested on the serrated blade of the blade seat.

* * * * *